United States Patent [19]

Strong

[11] 4,454,793

[45] Jun. 19, 1984

[54] ATTACHMENT FOR A MITER GAUGE

[76] Inventor: Donald Strong, 20425 Beatrice, Livonia, Mich. 48152

[21] Appl. No.: 368,991

[22] Filed: Apr. 16, 1982

[51] Int. Cl.[3] ..... B27B 25/10

[52] U.S. Cl. ..... 83/421; 83/425; 83/437; 83/477.2; 83/581; 83/700

[58] Field of Search ..... 83/435.1, 437, 441.1, 83/444, 477.2, 581, 700, 421, 425; 269/49, 157; 144/253 R, 252 R; 403/255

[56] References Cited

U.S. PATENT DOCUMENTS 3,672,710 6/1972 Kroopp ..... 403/255

4,259,887 4/1981 Dean ..... 83/581

*Primary Examiner*—James M. Meister

*Assistant Examiner*—J. L. Knoble

*Attorney, Agent, or Firm*—Charles W. Chandler

[57] ABSTRACT

An attachment for a miter gauge of the type having an arm slidably movable in the slot of a work table so that a wooden workpiece is moved into engagement with a table saw blade depending upon the angle of the arm with respect to the miter gauge body. The attachment is mounted on the miter gauge in such a manner that two workpieces one with a taper cut and the other with a miter cut can be successively cut and then joined along their bias edges to form a ninety degree joint, without readjusting the miter gauge.

1 Claim, 7 Drawing Figures

ATTACHMENT FOR A MITER GAUGE

BACKGROUND OF THE INVENTION

This invention is related to an attachment for a miter gauge used for cutting and tapered cuts in wooden workpieces, and more particularly to an attachment for a miter gauge having a novel means for locking the attachment to the gauge body to form a workpiece-engaging surface having a ninety degree angle whereby a pair of workpieces can be successively cut and then joined together to form a ninety degree joint.

Wooden miter joints are usually formed by employing a miter gauge having an arm slidably received in a slot in a work table, the arm being locked at a selected angle to the miter gauge body depending upon the angle of the edge to be cut in the workpiece.

Sometimes the user desires to form a miter joint which requires him to cut two workpieces that are joined along their bias edges. A conventional miter gauge can be used to cut two such workpieces, however, it is difficult to precisely cut two workpieces so that they form a ninety degree joint where the miter angle of the first workpiece is different than the angle of the second workpiece. Conventionally, the user cuts the first workpiece using a miter gauge and then uses a taper jig to cut the second workpiece. If the adjustment is not precise, the two workpieces do not form a precise ninety degree joint.

SUMMARY OF THE INVENTION

The broad purpose of the present invention is to provide an attachment for a conventional miter gauge which permits the user to cut two successive workpieces, one having a tapered end, the other having a mitered end, without readjusting the miter gauge arm, in such a manner that the workpieces, when joined along their bias edges, form a ninety degree joint. The preferred embodiment employs a special locking means for adjusting the position of the attachment along the miter gauge body to accommodate various size workpieces. Preferably the attachment includes a fence that is connected to the miter gauge body. The fence has a channel-shaped slot. A stop is connected to the fence to a channel-shaped slot. A stop is connected to the fence to cooperate to form a ninety degree workpiece-engaging surface. The stop has a movable locking member with a tapered opening. A threaded fastener has its end received in the tapered opening to cam the locking member and to releasibly clamp the slot opening between the tongue and the locking member body.

Still further objects and advantages of the invention will become readily apparent to those skilled in the art to which the invention pertains upon reference to the following detailed description.

DESCRIPTION OF THE DRAWINGS

The description refers to the accompanying drawings in which like reference characters refer to like parts throughout the several views, and in which.

DESCRIPTION OF THE PREFERRED EMBODIMENT

Figure 1:
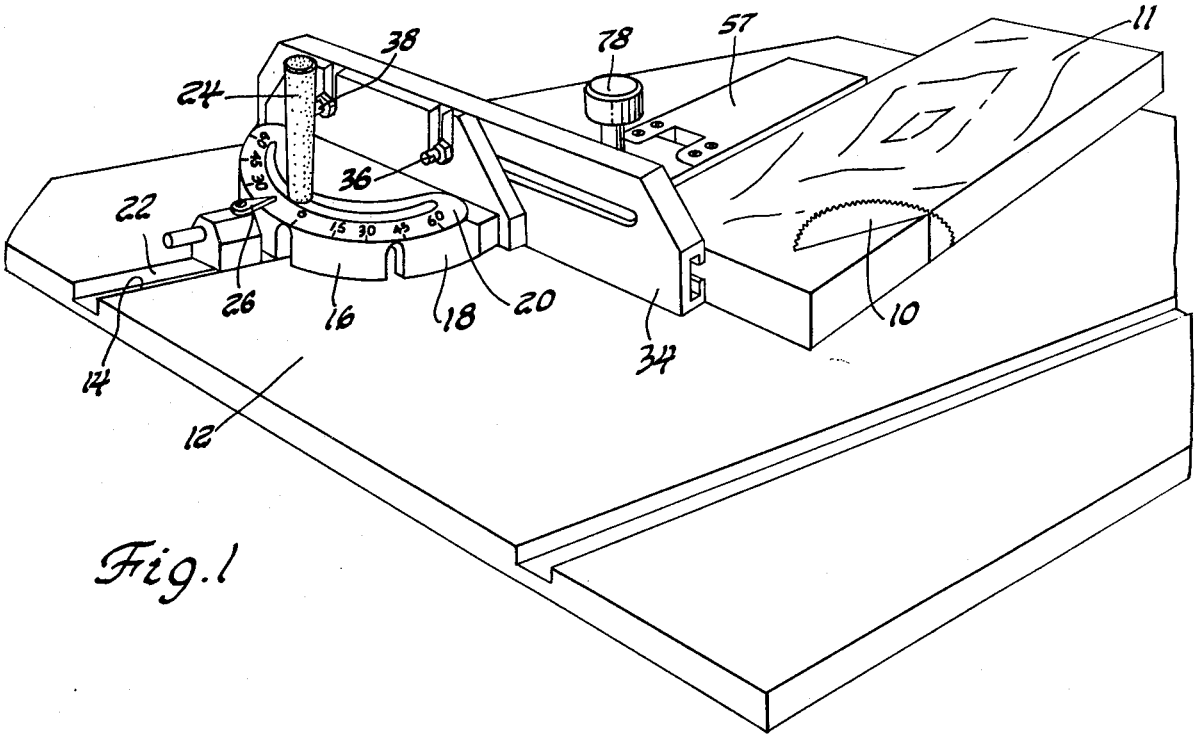
FIG. 1 is a perspective view illustrating a miter gauge having an attachment embodying the invention, supporting a wooden workpiece adjacent a table saw blade.

Referring to the drawings, FIG. 1 illustrates a conventional table saw blade 10 mounted on a work table 12 having a slot 14. A miter gauge 16 has a body 18 with a semicircular gauge and indicia 20 marked along the edge of the gauge to indicate various angular positions. An elongated arm 22 is pivotally connected to body 18 and slidably mounted in slot 14. A handle 24 is threadably connected to arm 22 to lock it in a selected angle to body 16 according to pointer means 26.

The miter gauge body has an elongated face 30. A workpiece 11 engages this face and then is pushed along a path defined by slot 14 into cutting engagement with table saw blade 10. The angle of the cut depends upon the angle of the workpiece with respect to slot 14. Thus by adjusting body 18 with respect to the slot, the user can select the bias angle of the finished workpiece.

Figure 6:
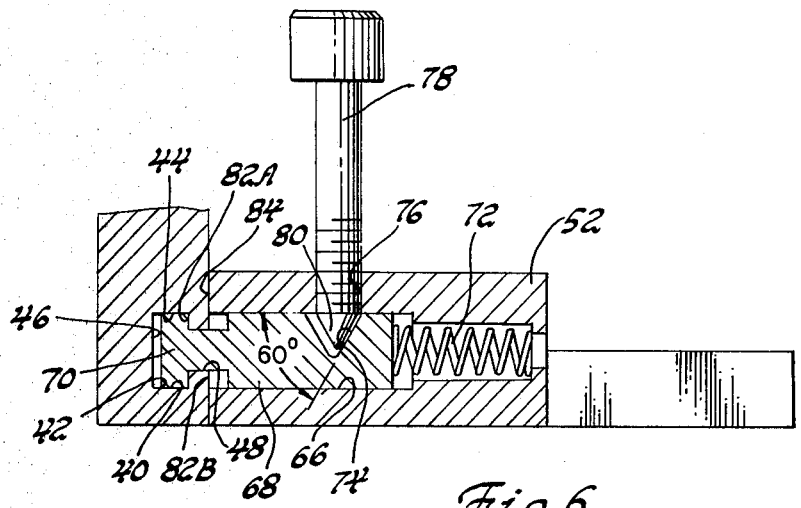
FIG. 6 is an enlarged view seen along lines 6—6 of FIG. 3.

An attachment generally indicated at 32, is mounted on miter gauge body 18. The attachment includes a fence 34. Fastener means 36 and 38 connect the fence in abutment with miter gauge face 30. The bottom surface of the fence is aligned with the bottom of the miter gauge body. The fence has a channel-shaped slot 40 running the full length of the fence. The slot, as best illustrated in FIG. 6, has opposed walls 42 and 44, a base 46 and a neck 48.

Figure 2:
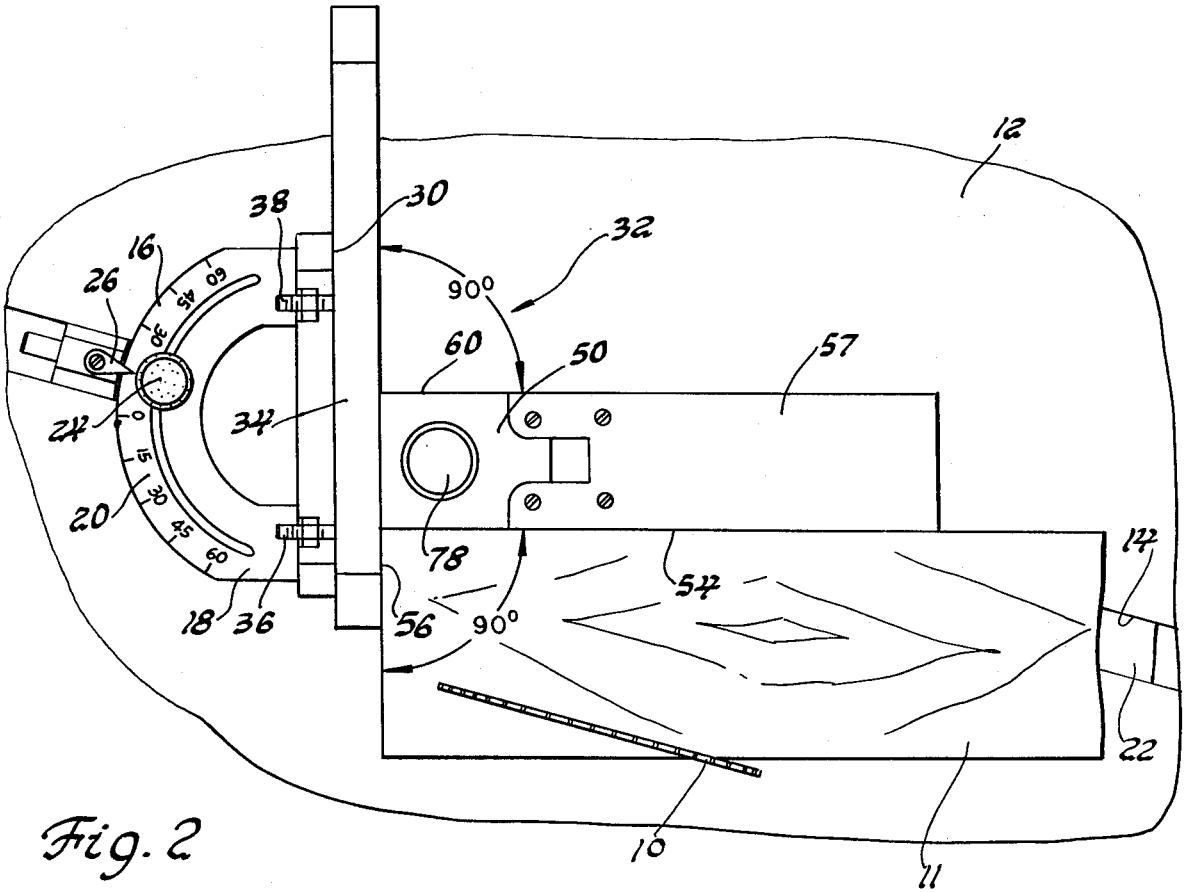
FIG. 2 is a plan view of the preferred miter gauge and attachment illustrated for cutting a taper on the first workpiece.

Referring to FIG. 2, a stop unit 50 is connected to fence 34. Stop unit 50 has a body 52 with a work-engaging surface 54 disposed at a ninety degree angle with respect to work-engaging surface 56 of the fence. The bottom of the stop unit is also aligned with the bottom of the miter gauge body, both of which are disposed over arm 22. The stop unit also has a similar work-engaging surface 60 disposed at a ninety degree angle with respect to surface 56 of the fence so that a workpiece can be mounted on either side of the stop unit. An extension 57 is connected to stop unit 52 to accommodate the length of the workpiece 11.

Figure 7:
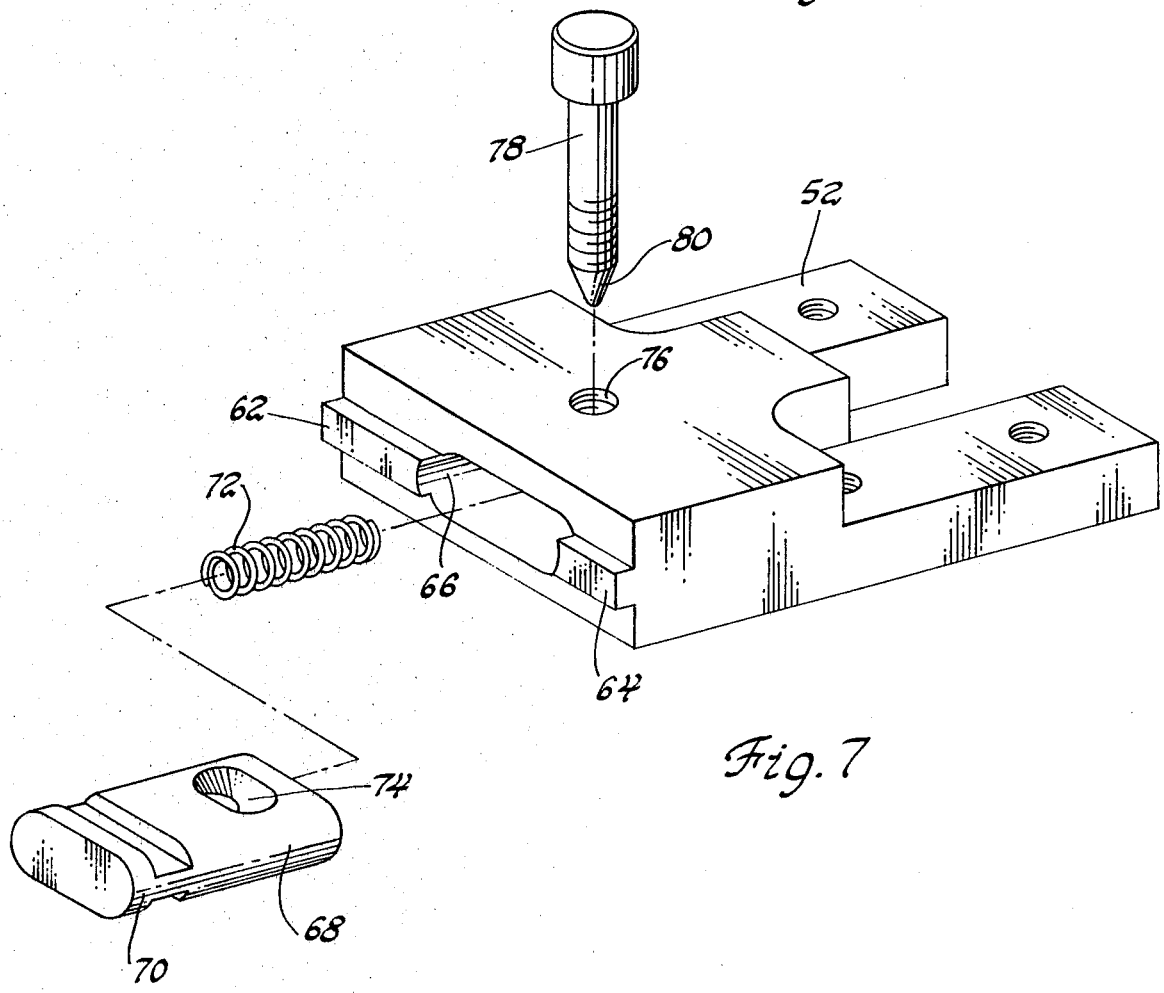
FIG. 7 is an exploded view of the locking means.

Referring to FIG. 7, the stop unit has a pair of elongated tongues 62 and 64 receivable in the fence slot. The stop unit body has an opening 66 disposed between tongues 62 and 64. A locking member 68 is slidably received in opening 66. The forward edge of the locking unit has a tongue 70 with a cross-section similar to the shape of slot 40.

A spring 72 is disposed in the stop unit to bias locking member 68 out of opening 66. The locking member has a tapered opening 74 aligned with a threaded opening 76 in the top of stop unit body 52, when tongue 70 is received in slot 40. A threaded adjusting member 78 having a handle is received in threaded opening 76.

As best illustrated in FIG. 6, adjusting member 78 has a conical point 80 which engages the rear wall of opening 74 to cam shoulders 82A and 82B of tongue 70 toward surface 84 of the stop body. The arrangement is such that as the user adjusts member 78, neck 48 is clamped between the tongue and body 52.

To unlock the stop unit from the fence, the user unscrews member 78 to disengage it from the rear tapered wall of opening 74. The user can then slide the unit along slot 40 to either readjust the location of the stop unit or to separate it from the fence.

Figure 3:
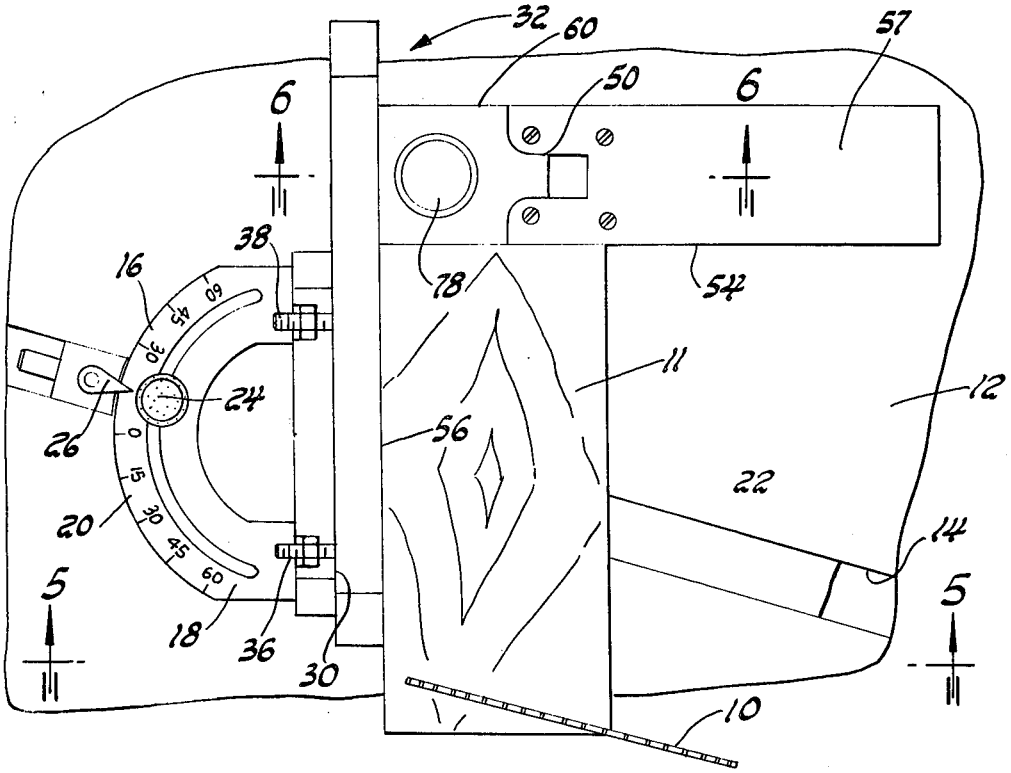
FIG. 3 is a view similar to FIG. 2 but showing a second workpiece being cut with a mitered end.
Figure 4:
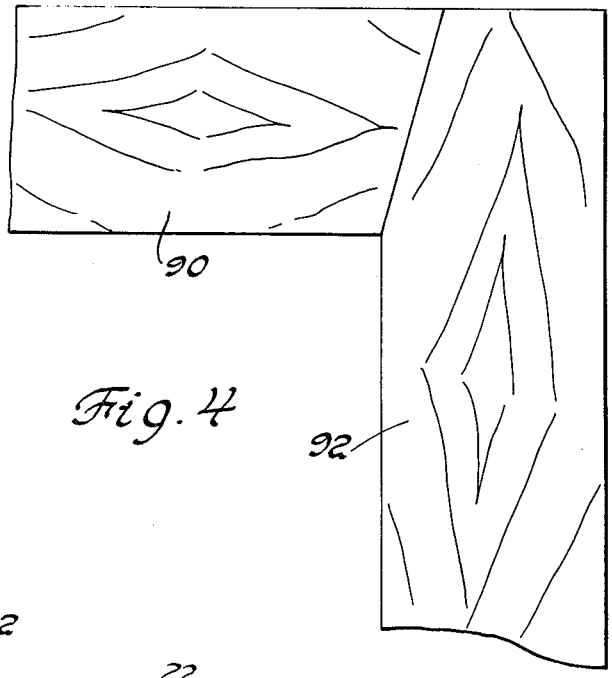
FIG. 4 is a view showing the two workpieces joined together to form a 90° joint.
Figure 5:
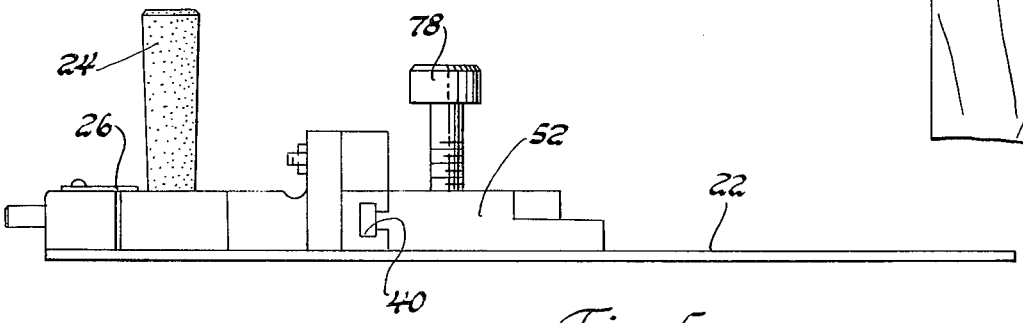
FIG. 5 is an enlarged view as seen along lines 5—5 of FIG. 3.

In use, the user forms a 90° joint from a pair of wood workpieces 90 and 92 by placing first workpiece 11 into engagement with work-engaging surfaces 56 of the fence and 54 of the stop unit after he has adjusted the angle of arm 22 with respect to miter gauge body. He then moves the miter gauge body, the attachment and the workpiece into cutting engagement with the table saw blade to remove the corner of the workpiece as illustrated in FIG. 2. The angle can be any desired angle. He then places second workpiece 92 in abutment with the fence, as illustrated in FIG. 3, and cuts off the end of this workpiece. It is to be noted that the portions removed from both workpieces are such that by joining the two workpieces, as illustrated in FIG. 4, with their bias ends in abutment, they form a right angle joint. This is accomplished without readjusting the angle of arm 22 of the miter gauge body.

Having described my invention, I claim:

1. An attachment for a miter gauge having a body having a workpiece-engaging surface, an arm pivotally connected to the body, and means for locking the arm at a selected angle with respect to the workpiece-engaging surface, said arm being slideably receivable in the slot of a work table for guiding the gauge body along a linear path of motion with respect to a table saw blade, said attachment comprising:

a fence having an elongated work-engaging surface and means for attaching the fence to the miter gauge body, the fence having an elongated slot having a neck forming a narrowed opening;

stop means having a body aligned with the bottom of the miter gauge body, and a pair of spaced tongues slideably received in the slot of the fence so as to be movable therealong to an adjusted position, said stop means having an elongated work-engaging surface disposed at a 90° angle with respect to the work-engaging surface of the fence;

the stop means body having an opening adjacent the slot;

a locking member slidably disposed in the stop means body opening between said tongues, the locking member having shoulder means in the fence slot such that the neck of the slot is disposed between the shoulder means and the stop means body; and locking means for camming the shoulder means toward the stop means body whereby the neck of the fence slot is clamped between the shoulder means and the stop means body.

* * * * *